US010900654B1

(12) United States Patent
Nguyen et al.

(10) Patent No.: US 10,900,654 B1
(45) Date of Patent: Jan. 26, 2021

(54) SMALL APERTURE LIGHTING DEVICE

(71) Applicant: Troy-CSL Lighting Inc., City of Industry, CA (US)

(72) Inventors: Vincent Nguyen, Garden Grove, CA (US); Jacob Benjamin Hawkins, Sierra Madre, CA (US); Joshua Portinga, Chino Hills, CA (US)

(73) Assignee: Troy-CSL Lighting Inc., City of Industry, CA (US)

( * ) Notice: Subject to any disclaimer, the term of this patent is extended or adjusted under 35 U.S.C. 154(b) by 0 days.

(21) Appl. No.: 16/855,509

(22) Filed: Apr. 22, 2020

(51) Int. Cl.

| | |
|---|---|
| ***F21V 29/00*** | (2015.01) |
| ***F21V 29/71*** | (2015.01) |
| ***F21S 8/02*** | (2006.01) |
| *F21V 23/00* | (2015.01) |
| *F21Y 105/18* | (2016.01) |
| *F21Y 115/10* | (2016.01) |

(52) U.S. Cl.
CPC ..... *F21V 29/713* (2015.01); *F21S 8/02* (2013.01); *F21V 23/001* (2013.01); *F21V 23/003* (2013.01); *F21Y 2105/18* (2016.08); *F21Y 2115/10* (2016.08)

(58) Field of Classification Search
CPC .... F21V 29/713; F21V 23/003; F21V 23/001; F21S 8/92; F21Y 2105/18; F21Y 2105/10
USPC ..... 362/373
See application file for complete search history.

(56) References Cited

U.S. PATENT DOCUMENTS

| | | | | |
|---|---|---|---|---|
| 7,722,220 | B2 * | 5/2010 | Van De Ven | F21S 8/026 362/294 |
| 7,722,227 | B2 * | 5/2010 | Zhang | F21V 21/04 362/364 |
| 7,980,736 | B2 * | 7/2011 | Soderman | F21V 29/70 362/373 |
| 8,672,518 | B2 * | 3/2014 | Boomgaarden | F21V 29/713 362/294 |
| 8,723,092 | B2 | 5/2014 | Bartenbach | |
| 9,933,136 | B2 | 4/2018 | Anselm et al. | |
| 10,079,460 | B2 | 9/2018 | Dressel et al. | |
| 10,151,461 | B2 | 12/2018 | Petzold | |
| D863,645 | S | 10/2019 | Petzold | |
| 2008/0285271 | A1 * | 11/2008 | Roberge | F21V 29/677 362/235 |
| 2009/0086474 | A1 * | 4/2009 | Chou | F21K 9/90 362/230 |

(Continued)

*Primary Examiner* — Ali Alavi
(74) *Attorney, Agent, or Firm* — Foley & Lardner LLP

(57) ABSTRACT

A lighting device assembly includes a light source and an optic attached to a first heat sink member, a second heat sink member connected in thermal communication with the first heat sink member, and an aperture member connected to the second heat sink member. The aperture member has an inner surface having steps surrounding a light exit opening to reduce a thickness dimension. The edge of the light exit opening is angled radially outward toward its light exit side. A third heat sink member is connected in thermal communication with the second heat sink member, and has a plurality of openings to receive one or more plaster materials. The third heat sink member has a first region and a second region at least partially surrounding the first region, the second region has a reduced heat conduction capability relative to the first region, to inhibit a transfer of heat to the outer perimeter of the body of the further heat sink member.

20 Claims, 6 Drawing Sheets

(56) References Cited

U.S. PATENT DOCUMENTS

| | | | | |
|---|---|---|---|---|
| 2009/0141506 | A1* | 6/2009 | Lan | F21V 33/0044 362/351 |
| 2014/0063817 | A1 | 3/2014 | Bartenbach | |
| 2018/0209635 | A1* | 7/2018 | Luiten | F28F 3/08 |
| 2019/0360682 | A1* | 11/2019 | Nakaya | F21S 45/49 |

* cited by examiner

SMALL APERTURE LIGHTING DEVICE

BACKGROUND

Certain lighting devices such as, but not limited to, room or area lighting devices, can include configurations that allow for mounting of the lighting device in a recess in a ceiling, wall or other structure. Such lighting devices may include a light source, such as a light emitting diode (LED). Typically, the brightness of an LED light source is at least partially related to the speed in which heat can be transferred away from the LED component. For example, it may be desirable to maintain the temperature of the LED under about 105° Celsius for improved or maximum light output and efficiency. However, in contexts in which the lighting device is mounted in a ceiling, wall or other object (for example, as a recessed lighting device), the LED component may be located within an enclosed or poorly ventilated environment within the ceiling, wall or other object, which can inhibit the ability to transfer heat away from the LED.

Accordingly, aspects of various examples described herein can be configured to transfer and dissipate heat away from the LED, while allowing the lighting device assembly to be located within a recess in a ceiling, wall or other object. In other examples described herein, the lighting device assembly may be mounted in other suitable locations or environments.

SUMMARY

One or more examples and aspects described herein relate to a lighting device assembly having a first heat sink member, a light source attached to the first heat sink member and at least one further heat sink member supported by the first heat sink member. The at least one further heat sink member includes a further heat sink member comprising a generally plate-shaped body having an outer perimeter and a plurality of openings configured to receive one or more materials consisting of plaster, joint compound, spackling, drywall mud, gypsum-based paste, paste or putty. The body of the further heat sink member has a first region and a second region, the second region at least partially surrounding the first region. The second region of the body of the further heat sink has a reduced heat conduction capability relative to the first region of the further heat sink, to at least partially inhibit a transfer of heat to the outer perimeter of the body of the further heat sink member.

According to a further example embodiment, the plurality of openings include a first plurality of openings in the first region of the further heat sink member, and a second plurality of openings in the second region of the body of the further heat sink member. The second plurality of openings has sizes, shapes, arrangements or combinations thereof configured to provide the second region with reduced heat conduction qualities relative to the first region of the body of the further heat sink member.

According to a further example embodiment, the first plurality of openings comprise openings that have a first size, the second plurality of openings comprise openings that have a second size, and the second size is larger than the first size.

According to a further example embodiment, the first plurality of openings comprise openings that have a first shape, the second plurality of openings comprise openings that have a second shape, and the second shape is different than the first shape.

According to a further example embodiment, the first plurality of openings comprise openings that are arranged in a first array, the second plurality of openings comprise openings that are arranged in a second array, and the second array has a different pattern than the first array.

According to a further example embodiment, the first array comprises the openings arranged in a plurality of radial lines or spokes extending from a central opening in the further heat sink member, and wherein the radial lines or spokes define radial heat transfer paths between adjacent pairs of radial lines of openings.

According to a further example embodiment, each of the radial lines or spokes extend radially outward in a curve or spiral shape.

According to a further example embodiment, the first heat sink member is configured to receive heat generated by the light source and wherein the further heat sink member is arranged in thermal communication with the first heat sink member to receive and dissipate some of the heat received by the first heat sink member.

According to a further example embodiment, the first heat sink member comprises a generally solid, unitary body of metal having a recess or cavity defining an interior volume, wherein the light source is located within the interior volume.

According to a further example embodiment, the at least one further heat sink member includes said further heat sink member and a second heat sink member, wherein the second heat sink member is located between the first heat sink member and the further heat sink member, wherein the second heat sink member is in thermal engagement with the first heat sink member, and wherein the further heat sink member is in thermal engagement with the second heat sink member.

According to a further example embodiment, the first heat sink member has an opening arranged to pass light from the light source, and wherein the second heat sink member has yoke section that engages and threads with a threaded edge of the opening in first heat sink member, to connect the second heat sink member to the first heat sink member.

According to a further example embodiment, a lighting device assembly further comprises an optic member having a light entry side and a light exit side, the optic member being supported by the first heat sink member with the light entry side in a position to receive light from the light source, the optic member being configured to emit the light from the exit side.

According to a further example embodiment, a lighting device assembly further comprises an aperture member having a light passage aperture, the aperture member being connected to the second heat sink member in a position to align the light passage aperture to receive and pass light from the light exit side of the optic member.

According to a further example embodiment, the aperture member comprises a body having first and second openings through which the light may pass, the first opening being on a side of the body facing the optic member, wherein the second opening is on a side of the body facing an opposite direction as the side having the large opening, wherein the second opening is smaller than the first opening, and wherein the body of the aperture member has a curved or angled inner surface between the first and the second openings, the angled or curved surface having a plurality of steps surrounding the second opening to reduce a thickness dimension of the body of the aperture member adjacent the edge of the second opening.

According to a further example embodiment, the edge of the second opening is curved or angled radially outward toward a light exit side of the second opening.

One or more further examples and aspects described herein relate to a lighting device assembly having a first heat sink member, a light source attached to the first heat sink member, and an optic member having a light entry side and a light exit side, where the optic member is supported by the first heat sink member with the light entry side in a position to receive light from the light source, and where the optic member is configured to emit the light from the light exit side. A second heat sink member is connected to and in thermal communication with the first heat sink member, where the second heat sink member has an opening. An aperture member having a light passage aperture is connected to the second heat sink member in a position to align the light passage aperture to receive and pass light from the light exit side of the optic member. The aperture member comprises a body having first and second openings through which the light may pass, the first opening being on a side of the body facing the optic member, wherein the second opening is on a side of the body facing an opposite direction as the side having the large opening. The second opening is smaller than the first opening. The body of the aperture member has a curved or angled inner surface between the first and the second openings. The angled or curved surface has a plurality of steps surrounding the second opening to reduce a thickness dimension of the body of the aperture member adjacent the edge of the second opening.

According to a further examples of that embodiment, the edge of the second opening is curved or angled radially outward toward a light exit side of the second opening.

Further examples of that embodiment further comprise a third heat sink member connected to and in thermal communication with the second heat sink member, where the third heat sink member comprises a generally plate-shaped body having an outer perimeter and a plurality of openings configured to receive one or more materials consisting of plaster, joint compound, spackling, drywall mud, gypsum-based paste, paste or putty.

According to a further examples of that embodiment, the body of the third heat sink member has a first region and a second region, the second region at least partially surrounding the first region, where the second region of the body of the further heat sink has a reduced heat conduction capability relative to the first region of the further heat sink, to at least partially inhibit a transfer of heat to the outer perimeter of the body of the further heat sink member.

According to a further examples of that embodiment, the plurality of openings include a first plurality of openings in the first region of the third heat sink member, and a second plurality of openings in the second region of the body of the third heat sink member, where the second plurality of openings has sizes, shapes, arrangements or combinations thereof configured to provide the second region with reduced heat conduction qualities relative to the first region of the body of the third heat sink member.

BRIEF DESCRIPTION OF THE DRAWINGS

The above and other aspects and features of the present invention will become more apparent to those skilled in the art from the following detailed description of the example embodiments with reference to the accompanying drawings, in which.

DETAILED DESCRIPTION

Figure 1:
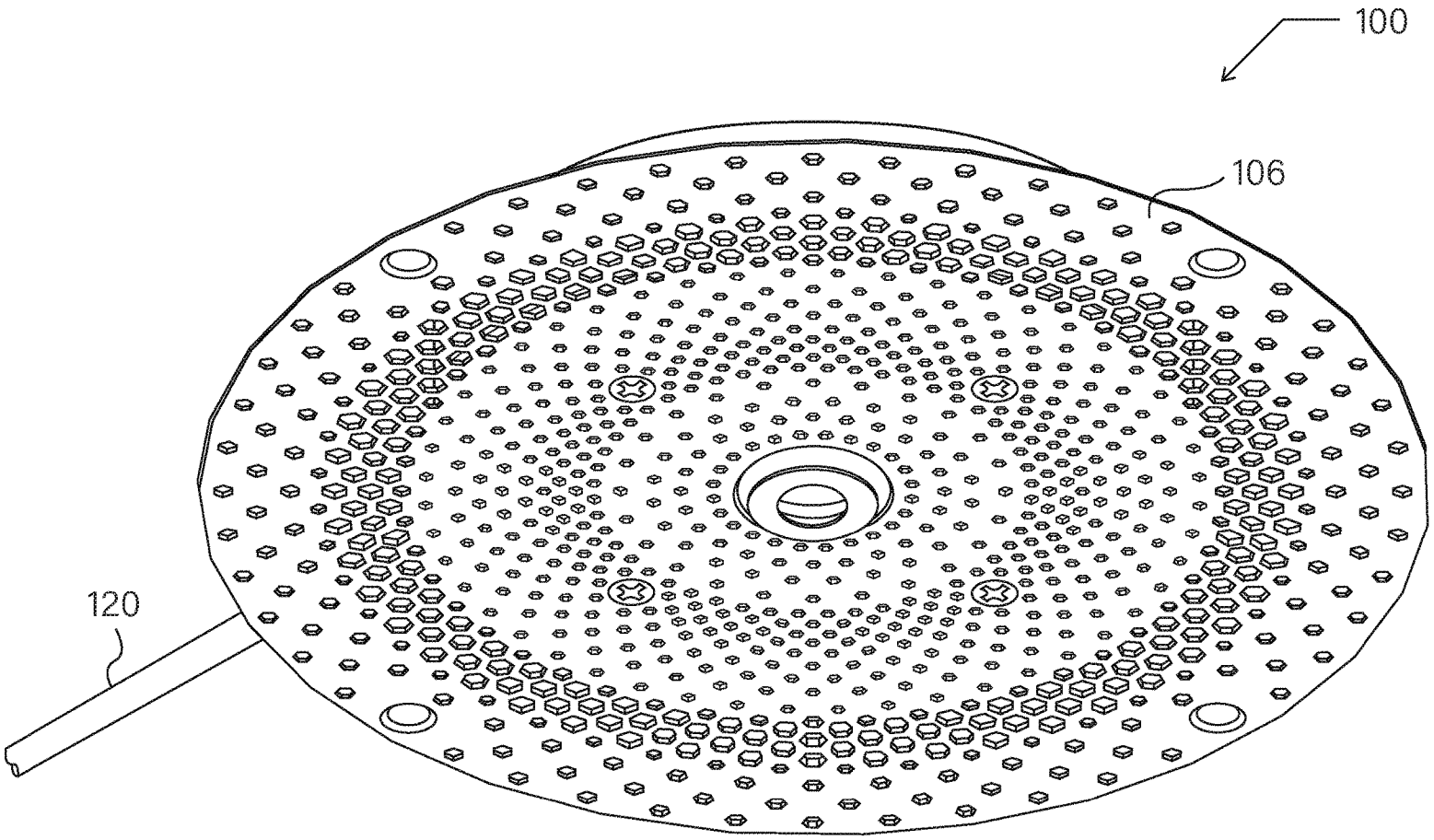
FIG. 1 is a perspective view of an example lighting device, showing an exposed side.

Hereinafter, example embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. Further, features or aspects within each example embodiment should typically be considered as available for other similar features or aspects in other example embodiments.

In the drawings, the relative sizes of elements, layers, and regions may be exaggerated and/or simplified for clarity. Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," "coupled to," "secured to" or "attached to" another element or feature, it can be directly on, connected to, coupled to, secured to or attached to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

According to various examples described herein, a lighting device assembly is configured to be installed in a recess or opening provided in a ceiling, wall or other object. In particular examples, the lighting device assembly is configured to be installed in a manner to appear flush or substantially flush with an exposed surface of the ceiling, wall or other object, when installed. In other examples, variations of the lighting device assembly may be configured to be installed in a manner that is not flush with the exposed surface (e.g., recessed, or protruding from the exposed surface of the ceiling, wall or other object), is surface-mounted on the exposed surface of the ceiling, wall or other object, or is mounted on a support structure (such as, but not limited to a sconce structure, pedestal, shaft or the like)

Figure 2:
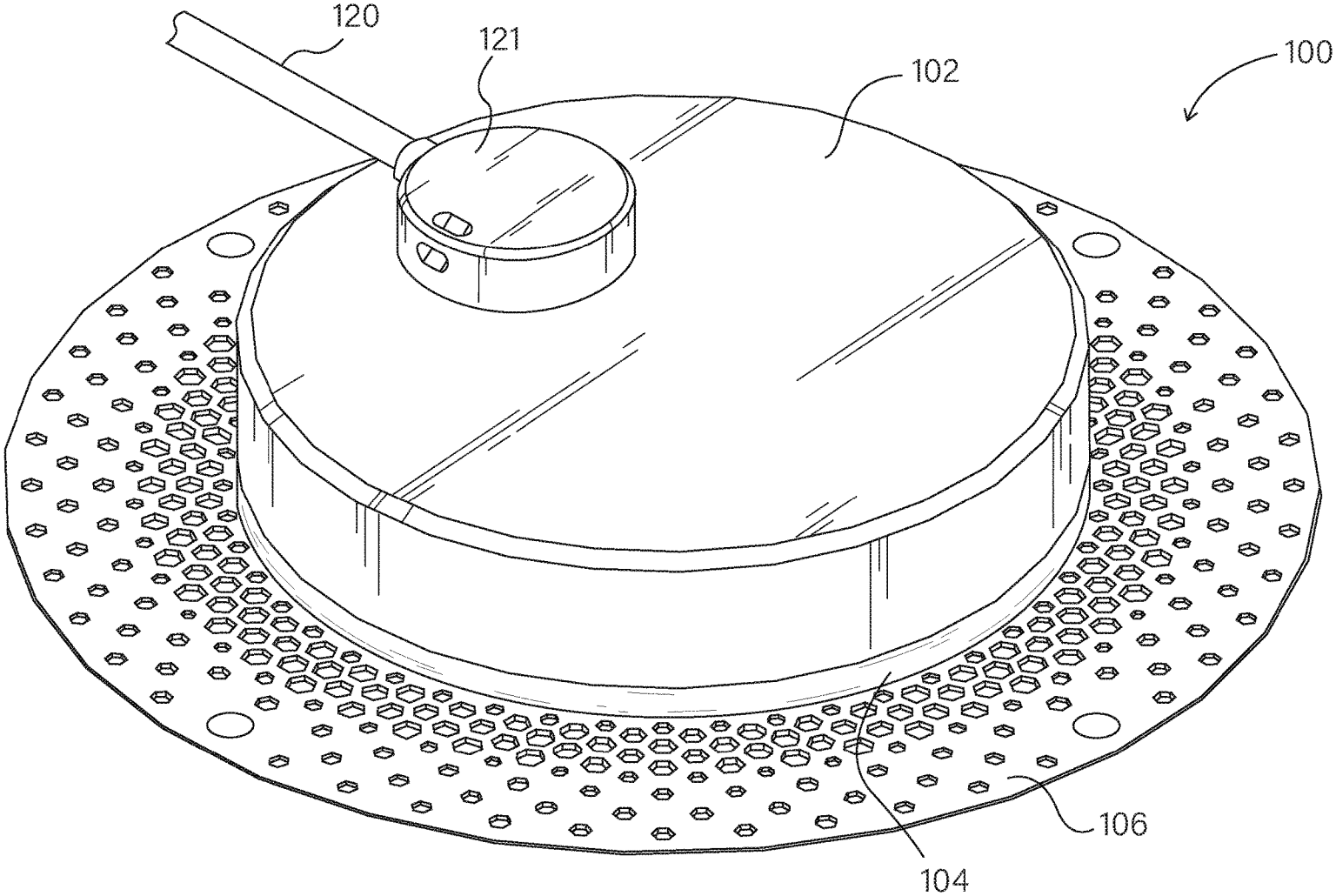
FIG. 2 is a further perspective view of the example lighting device of FIG. 1, showing a side facing opposite to the exposed side.
Figure 3:
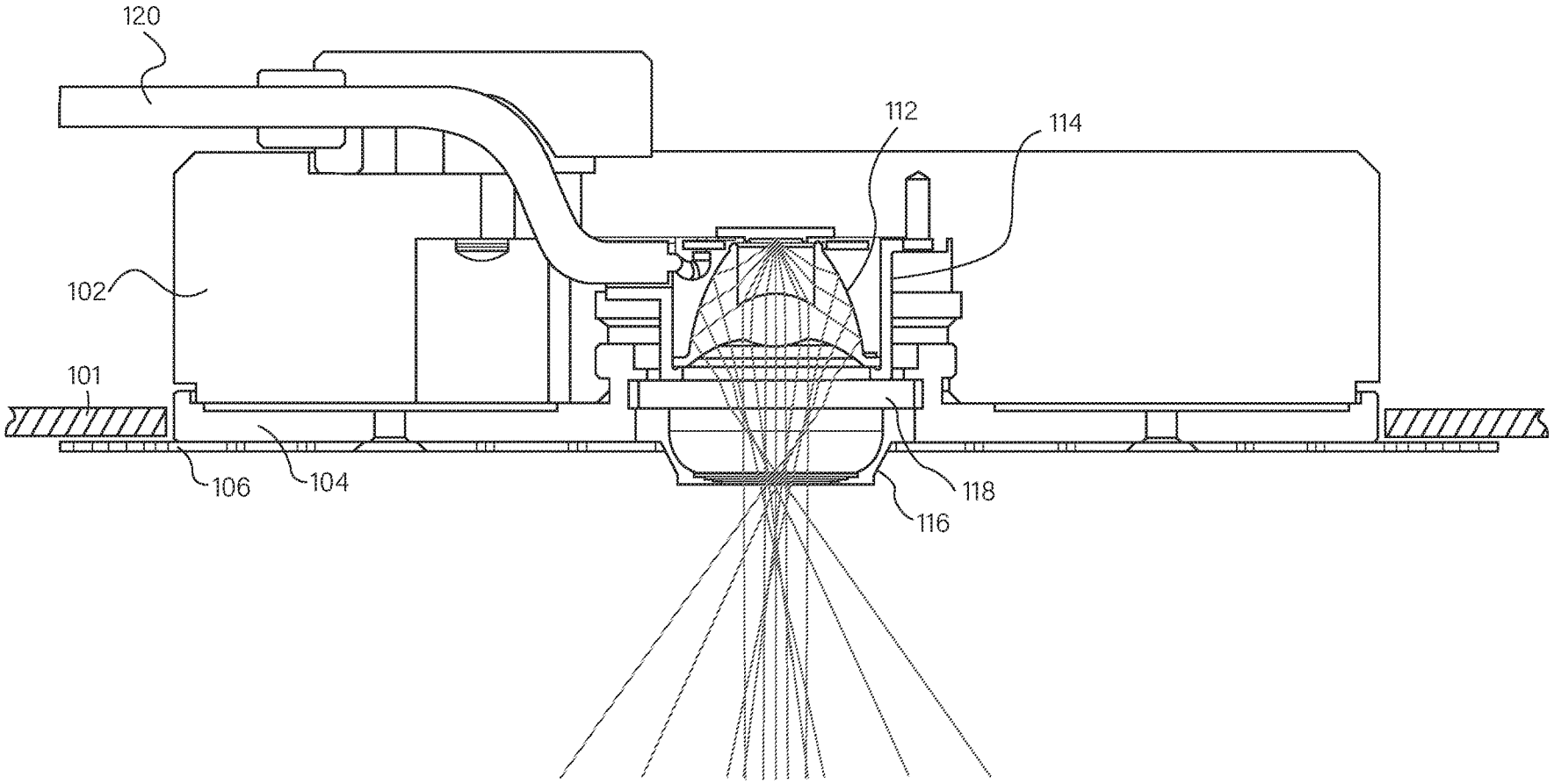
FIG. 3 is a cross-section view of the view of the example lighting device of FIG. 1.
Figure 4:
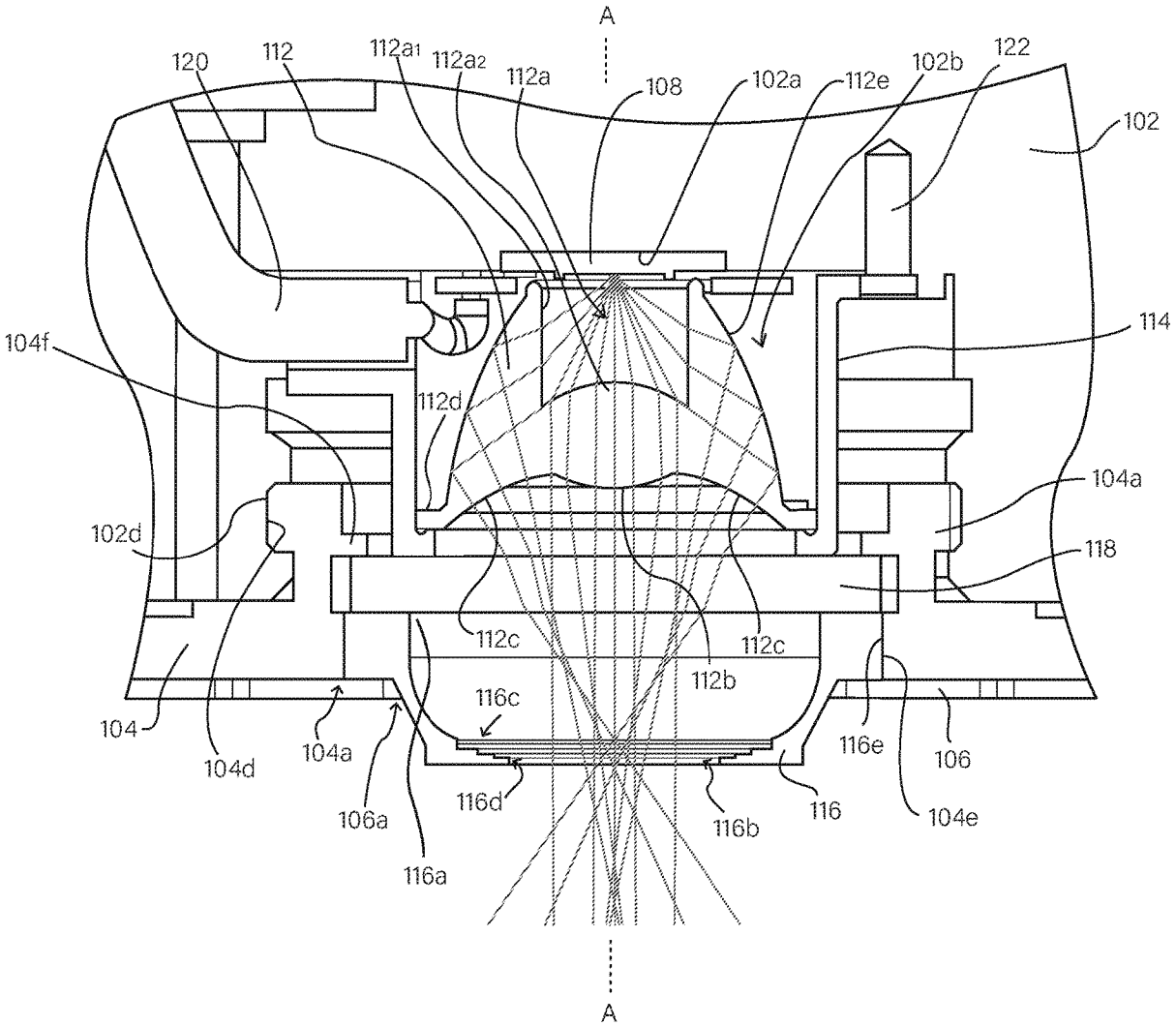
FIG. 4 is an enlarged cross-section view of a portion of the view shown in FIG. 3.
Figure 5:
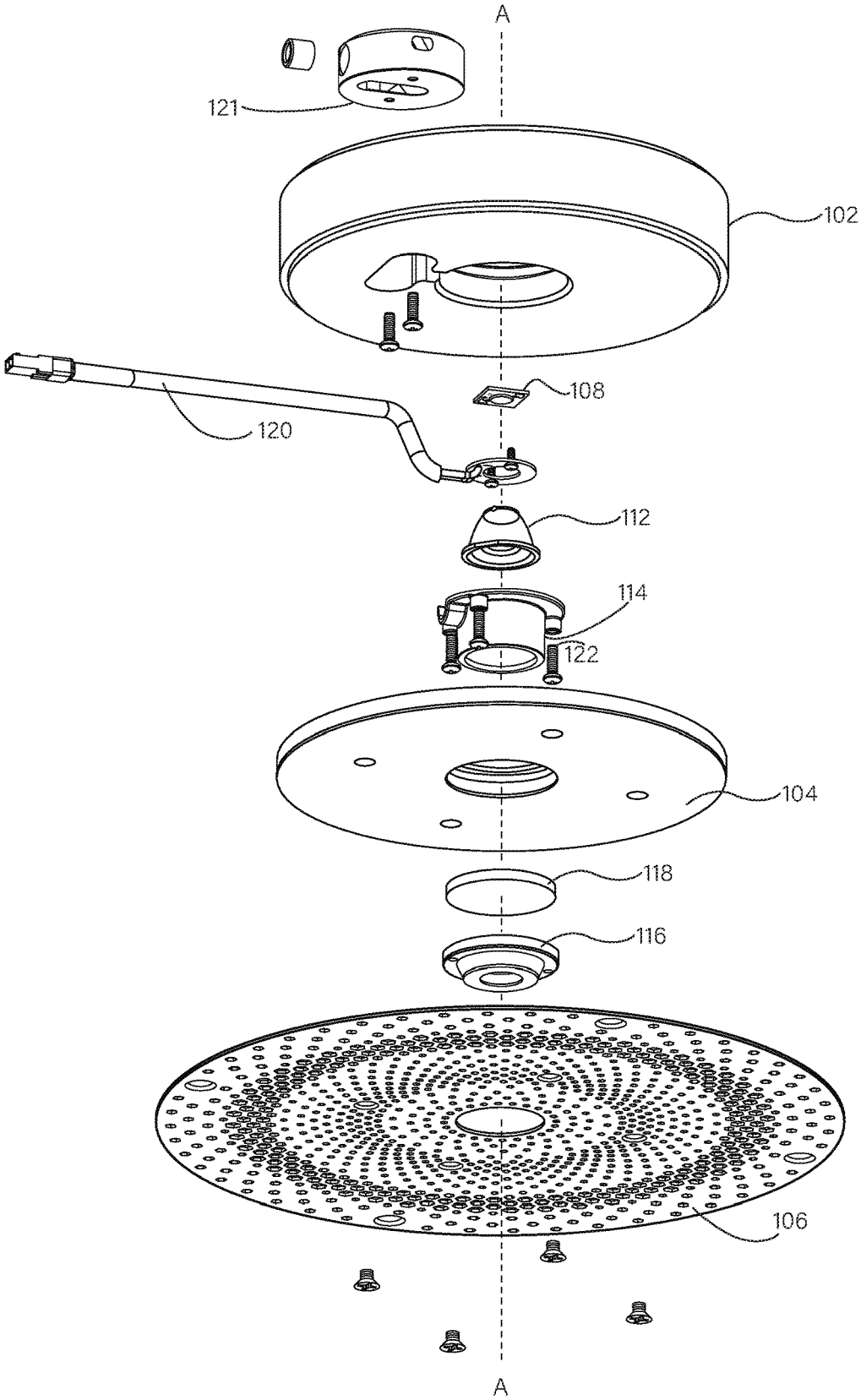
FIG. 5 is an exploded view of the example lighting device of FIG. 1.
Figure 6:
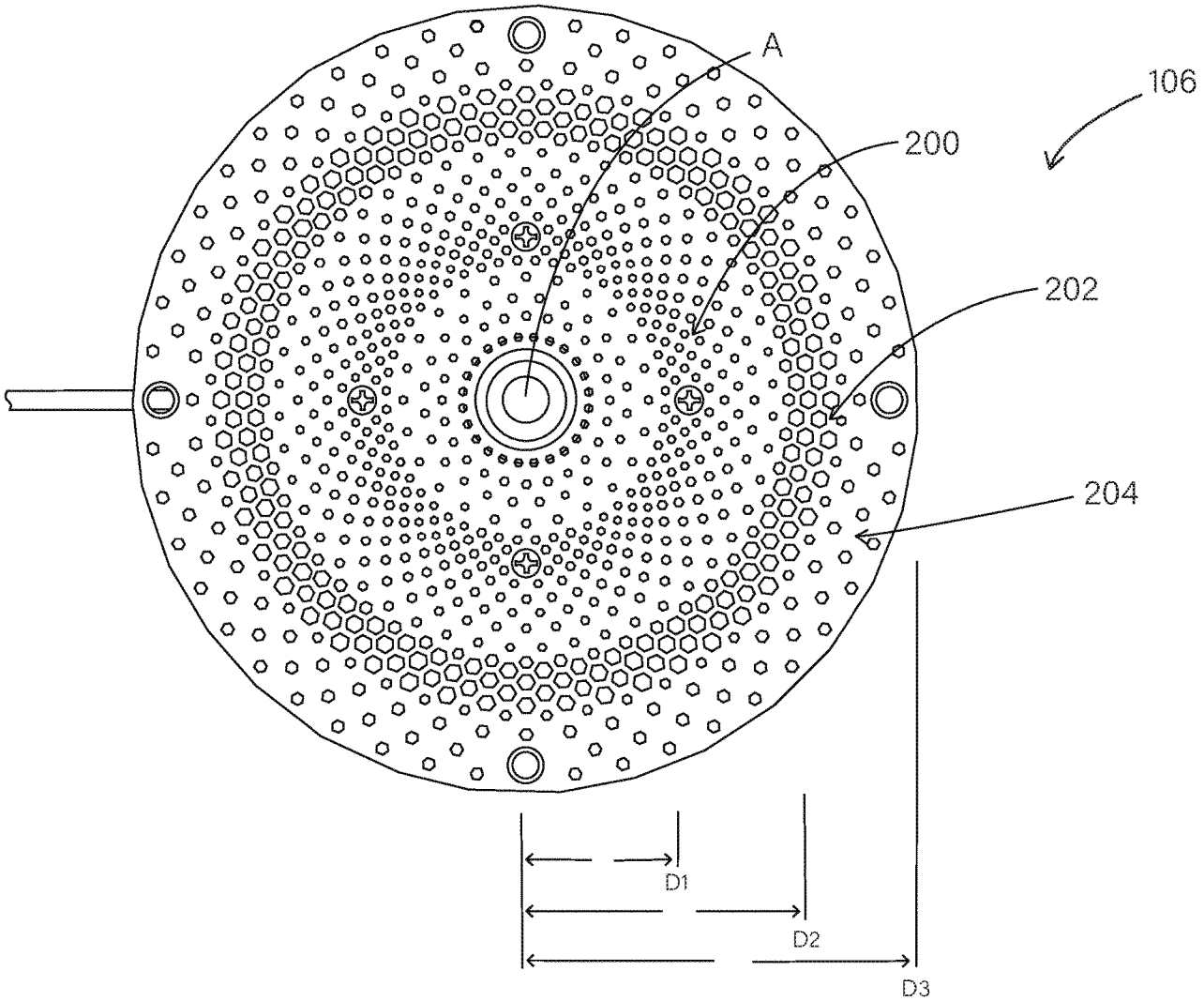
FIG. 6 is a side view showing the exposed side of the third heat sink member of the example lighting device in FIG. 1.

FIG. 1 is a perspective view of an example of a lighting device assembly 100, showing an outward facing side (a side of the lighting device assembly 100 that faces outward of a ceiling, wall or other object, when the lighting device assembly 100 is installed). FIG. 2 is a perspective view of the lighting device assembly 100, showing an inward-facing side (a side that faces inward of a ceiling, wall or other object, when the lighting device assembly 100 is installed). FIG. 3 is a cross-section view of the lighting device assembly 100, in an installed state (installed in a section 101 of a ceiling, wall or other object). FIG. 4 is an enlarged cross-section view of a portion of the view shown in FIG. 3. FIG. 5 shows an exploded view of the lighting device assembly 100. FIG. 6 shows an example of a pattern of openings in a third heat sink member of the lighting device assembly 100.

The lighting device assembly 100 includes a first heat sink member 102 and one or more further heat sink members. In the example in FIGS. 1-6, the lighting device assembly 100 includes two further heat sink members, composed of a second heat sink member 104 and a third heat sink member 106. The second heat sink member is configured to be connected to the first heat sink member for conduction of heat from the first heat sink member to the second heat sink member. The third heat sink member is configured to be connected to the second heat sink member for conduction of heat from the second heat sink member to the third heat sink member.

In addition to the first, second and third heat sink members 102, 104 and 106, the lighting device assembly in FIGS. 1-6 further includes an optic member 112, an optic holder 114, an aperture member 116 and a diffuser lens 118, as described below. In other examples, one or more of the optic holder 114, the aperture member 116, or the diffuser lens 118 may be omitted.

The first heat sink member 102 may be composed of a body of generally rigid material having good thermal conductivity characteristics to efficiently conduct heat. In certain examples, the first heat sink member 102 includes a single, unitary block or plate of aluminum, copper or other metal having significant or substantially great heat conduction capabilities. In certain examples, the first heat sink 102 may be formed (e.g., cast or forged) from solid aluminum. However, in other examples, the first heat sink member 102 may be composed of multiple parts that are fixed or connected together to form a heat sink structure as described herein.

The first heat sink member 102 includes a surface 102*a* on which a light source 108 is mounted. In particular examples, the light source 108 is mounted in thermal communication with the surface 102*a* of the first heat sink member 102, such that the first heat sink member 102 may efficiently receive and conduct heat from the light source 108. In certain examples, the surface 102*a* of the first heat sink member 102 may be in direct contact with the light source 108, to efficiently transfer heat away from the light source 108. In certain examples in which the light source 108 includes a circuit board on which one or more light emitting devices are mounted, the circuit board may be mounted in direct contact with (e.g., generally flat or flush against the surface 102*a*) to enhance the ability to transfer heat from the circuit board (or components on the circuit board) to the first heat sink member 102.

The light source 108 may include any suitable light emitting device or devices. In particular examples, the light source 108 includes one or more LEDs or other heat-generating light sources. In such examples, the one or more LEDs may be mounted on a circuit board or other support structure. As described herein, the first, second and third heat sink members 102, 104 and 106 are configured to conduct and dissipate heat away from the light source 108, which can significantly improve the efficiency and light output of the one or more LEDs (or other heat-generating light sources).

In the example in FIGS. 1-6, the first heat sink member 102 includes a generally disc-shaped body having a recess or cavity 102*b* that defines an interior volume in which the surface 102*a* (and the light source 108) is located. In other examples, the first heat sink member may have other suitable shapes with or without a recess or cavity.

In the example in FIGS. 1-6, the first heat sink member has an aperture or opening on a first side (the side of the first heat sink member 102 facing in the direction of the outward facing side of the lighting device assembly 100, i.e., downward in the orientation of FIGS. 3 and 4). The aperture or opening on the first side opens to the recess or cavity 102*b* of the first heat sink member 102.

The first heat sink member 102 may include one or more passages through which one or more electrical wires or other electrical conductors 120 extend. The electrical wires or other conductors 120 connect to the light source 108 located within the first heat sink member, and extend out of an opening in the first heat sink member 102 to a suitable driver circuit, control electronics and/or power supply. In some examples, the body of the first heat sink member 102 has one or more openings through which the electrical wires or other conductors 120 extend, and a cap 121 may be provided over the opening(s). The cap 121 may help protect the wires or conductors 120 during or after installation of the lighting device assembly 100. Alternatively or in addition, the cap 121 may direct the wires or conductors 120 in a desired orientation (such as, but not limited to a direction that is generally radially outward from the center of the first heat sink member 102 and the lighting device assembly 100 (e.g., horizontal in the orientation of FIGS. 3 and 4).

In various examples, the wires or other conductors 120 may include or be configured to connect to a source of electrical power (not shown) through a driver and/or other electronics (no shown) to convert power provided from the power source to a suitable power for driving the light source 108. In other examples, some or all of the driver and electronics may be provided on the light source 108 (e.g., on a circuit board of the light source 108), or in another electronic circuit located on the first heat sink member 102. In examples in which the light source is an LED light source, the driver and electronics may include an LED driver to convert the power from the power source to a low-voltage power suitable to drive the LED light source. In some examples, the driver or electronics may include a processor to execute instructions stored on memory (e.g., non-transient computer readable media) to process data and/or to control various functions of the lighting device (e.g., temperature, light output, color of light, direction of light, focus of light, and/or the like).

In the example of FIGS. 1-6, the second heat sink member 104 is configured to selectively connect with or disconnect from the first heat sink member 102. In some examples, the second heat sink member 104 is configured to be selectively disconnected from a connected state with the first heat sink member 102, to allow access to the interior volume of the first heat sink member 102, for example, to service, change or replace the light source 102, or the optic member 112 (or both). After servicing, changing or replacing of the light source 102 or the optic member 112, the second heat sink 104 may be connected or re-connected to the first heat sink member 102. In some examples, the second heat sink member 104 is configured to be selectively disconnected from a connected state with the first heat sink member 102, to allow replacement of the optic member 112 with a different optic member, for example, to change the beam angle or other optical characteristic of the lighting device assembly 100. In certain examples, the lighting device assembly 100 may be configured to operate with any one of multiple different optic members, each having a different beam angle or other optical characteristic relative to other ones of the multiple optic members, including, but not limited to a 30 degree beam angle, a 50 degree beam angle, or other suitable beam angle. The second heat sink member 104 includes a body of material having good thermal conductivity characteristics such as materials discussed above with regard to the first heat sink member 102, or other suitable material. In certain example examples, the second heat sink member 104 may be formed (e.g., cast or forged) from solid aluminum, copper or other metal having good heat conduction characteristics.

The second heat sink member 104 includes a rigid body that extends along and covers a portion of or all of the first side of the first heat sink member, when the second heat sink member 104 is connected to the first heat sink member 102, as shown in FIGS. 3 and 4. In the example in FIGS. 1-6, the second heat sink member 104 has a generally plate-shaped body that has an outer periphery shape that generally aligns with and corresponds to the shape of the outer periphery of the first heat sink member 102. In the illustrated example, the generally plate-shaped body of the second heat sink member 104 has a round or generally disc shape, corresponding in diameter to the generally disc shape of the first heat sink member 102. In other examples, the second heat sink member 104 may have other suitable shapes.

In particular examples, the second heat sink member 104 has a first side and a second side, where the first side faces in the direction of the outward facing side of the lighting device assembly 100 (downward in the orientation of FIGS. 3 and 4) and the second side faces a direction opposite to the direction of the first side (upward in the orientation of FIGS. 3 and 4). The second side of the second heat sink member 104 has a surface that abuts relatively flat and flush against a surface of the first side of the first heat sink member 102 and provides a good thermal conduction interface between the first and second heat sink members, to enhance conduction of heat from the first heat sink member to the second heat sink member. In other examples, a small gap may be provided between portions of the abutting surfaces of the first and the second heat sink members 102 and 104. In such examples, the small gap can reduce friction between the abutting surfaces of the first and the second heat sink members 102 and 104, to allow the second heat sink member 104 to be more easily rotated by hand, relative to the first heat sink member 102, to connect or disconnect the second heat sink member 104 to the first heat sink member 102.

The second heat sink member 104 includes an opening 104*a*, extending through the body of the second heat sink member 104, from the first side to the second side of the second heat sink member 104. The opening 104*a* in the second heat sink member 104 aligns with the opening on the first side of the first heat sink member 102, when the second heat sink member 104 is connected to the first heat sink member 102, as shown in FIGS. 3 and 4. The second heat sink member 104 includes a protruding yoke section 104*b* around the aperture or opening 104*a*. The yoke section 104*b* extends at least partially into the aperture or opening in the first heat sink member 102, when the second heat sink member 104 is connected to the first heat sink member 102, as shown in FIGS. 3 and 4.

The second heat sink member 104 may connect to the first heat sink member 102 in any suitable manner, or with any suitable connection mechanism including, but not limited to one or more bolts, screws, or other threaded fasteners, rivets, glue or other adhesive, solder, welds, clamps, friction or press fitted features, combinations thereof, or the like. However, in particular examples, the yoke section 104*b* includes a threaded outer surface 104*d* that engages a correspondingly threaded inner surface 102*d* of the aperture or opening to the recess or cavity 102*b*, to allow the second heat sink member 104 to connect to the first heat sink member 102 by a threading connection of the yoke section 104*b* with the aperture or opening to the recess or cavity 102*b*. In such examples, the second heat sink member 104 may be connected to the first heat sink member 102 by aligning and engaging the yoke section 104*b* with the aperture or opening to the recess or cavity 102*b*, and rotating the second heat sink member 104 about an axis A of the aperture or opening, relative to the first heat sink member 102, to thread the yoke section 104*b* with the threaded aperture or opening in the first heat sink member 102.

In certain examples, the second heat sink member 104 may include an annular lip or ridge 104*c*, such as, but not limited to a ridge extending upward in the orientation of FIGS. 3 and 4, from the second side of the second heat sink member 104 (e.g., at the perimeter of the body of the second heat sink member 104 as shown in FIGS. 3 and 4, or at any other suitable location on the body of the second heat sink member 104). The annular lip or ridge 104*c* is configured and arranged to align with an annular groove or recess 102*c*, such as, but not limited to a groove or recess on a surface of the first side of the first heat sink member 102 (e.g., around the perimeter of the body of the first heat sink member 102 as shown in FIGS. 3 and 4, or at any other suitable location on the body of the first heat sink member 102). In such examples, the annular lip or ridge 104*c* may be received in the annular groove or recess 102*c*, while the second heat sink member 104 is rotated about an axis A for threading connection with the first heat sink member 102.

As discussed further, below, when the lighting device assembly 100 is installed in the ceiling, wall or other object 101, the first heat sink member 102 and the second heat sink member 104 may be located within (or partially within) an opening in a ceiling, wall or other object, while the third heat sink member 106 is located on or adjacent to an outer or exposed surface of the ceiling, wall or other object 101. In some examples, after or as part of the installation of the lighting device assembly 100, the third heat sink member 106 is configured to be covered (partially or completely) with one or more materials, such as, but not limited to materials commonly known or used as plaster, joint compound, spackling, drywall mud, gypsum-based paste, putty, or the like (collectively and individually referred to herein as plaster material). For example, after or as part of the installation of the lighting device assembly 100, the third heat sink member 106 may be covered with such materials to appear as or become part of the exposed surface of the ceiling, and to hide the third heat sink member 106 from view.

In the example of FIGS. 1-6, the third heat sink member 106 is configured to selectively connect with or disconnect from the second heat sink member 104. In certain examples, one or more fasteners may be provided to selectively connect the third heat sink member 106 to the second heat sink member 104. The one or more fasteners may include, but are not limited to bolts, screws, or other threaded fasteners, rivets, glue or other adhesive, solder, welds, clamps, friction or press fitted features, combinations thereof, or the like. In the example in FIGS. 1-6, two threaded bolt fasteners 110*a* and 110*b* are shown, each extending through a respective opening in the third heat sink member 106 and into a respective threaded recess in the second heat sink member 104. In other examples, a single fastener or more than two fasteners may connect the third heat sink member 106 to the second heat sink member 104.

The third heat sink member 106 includes a body of material having good thermal conductivity characteristics such as discussed above with regard to the material of the first heat sink member 102, or other suitable material. In certain example examples, the third heat sink member 106 may be formed (e.g., cast or forged) from solid aluminum, copper or other metal having good thermal conduction characteristics. The third heat sink member 106 includes a rigid body that extends along and covers the surface of the first side (the side facing downward in the orientation of FIGS. 3 and 4) of the second heat sink member 104, when the third heat sink member 106 is connected to the second heat sink member 104, as shown in FIGS. 3 and 4.

In particular examples, the third heat sink member 106 has a first side and a second side, where the first side faces in the direction of the outward facing side of the lighting device assembly 100 (downward in the orientation of FIGS. 3 and 4) and the second side faces opposite to the first side (upward in the orientation of FIGS. 3 and 4). The second side of the third heat sink member 106 has a surface that abuts relatively flat and flush against a surface of the first side of the second heat sink member 104 and provides a good thermal conduction interface between the second and third heat sink members, to enhance conduction of heat from the second heat sink member to the third heat sink member.

In the example in FIGS. 1-6, the third heat sink member 106 has a generally flat, plate-shaped body that has an outer periphery shape that extends beyond the dimensions of the outer peripheries of the first heat sink member 102 and of the second heat sink member 104. In certain examples, the generally flat, plate-shaped body of the third heat sink member 106 is configured to be arranged generally flat against a portion of the exposed surface of the ceiling, wall or other object, when the light fixture assembly 100 is installed.

In the example in FIGS. 1-6, the third heat sink member 106 has a round-disc shape. In other examples, the third heat sink member 106 may have other suitable shapes including, but not limited to, a generally flat rectangular, square or other polygonal-shaped plate, oval or other curved-shaped plate, or other curved or complex shaped plate (including shapes with combined curved and strait-edges). In yet other examples, the third heat sink member 106 may have other shapes having non-flat surfaces, or that are not plate-shaped.

The third heat sink member 106 has a central opening 106*a*, extending through the body of the third heat sink member 106, from the first side to the second side of the third heat sink member 106. The central opening 106*a* in the third heat sink member 106 aligns with the opening 104*a* in the second heat sink member 104 and with the opening on the first side of the first heat sink member 102, when the second and third heat sink members 104 and 106 are connected together and to the first heat sink member 102, as shown in FIGS. 3 and 4.

In particular examples, the third heat sink member 106 extends beyond the perimeter of the first and second heat sink members 102 and 104, to provide an extended surface to abut against the exterior facing surface of the ceiling, wall or object. The extended surface of the third heat sink member 106 provides a retaining surface or mud plate, for receiving and retaining materials commonly known or used as plaster, joint compound, spackling, drywall mud, gypsum-based paste, putty, or the like (plaster material). In certain examples, the third heat sink member 106 may include a plurality of plaster/mud openings (each opening extending through the body of the third heat sink member 106, from the first surface to the second surface), to receive and hold such retaining material.

The plurality of plaster/mud openings in the third heat sink member 106 may be distributed uniformly, in one or more defined patterns, or randomly over the body of the third heat sink member 106. Each of the openings may have the same size and shape. Alternatively, different groups of plaster/mud openings (or each plaster/mud opening) may have a different size or shape than opening in other groups (or than each other plaster/mud opening). In certain examples, the size, shape, location, arrangement (or combinations thereof) of the plaster/mud openings in the third heat sink member 106 are configured to allow the third heat sink member to receive and dissipate heat from the second heat sink member, while also minimizing or reducing expansion or contraction of the body of the third heat sink member 106 due to heating or cooling of the third heat sink member 106.

In particular, when the lighting device assembly 100 is installed in a ceiling, wall or other object, the third heat sink member 106 may be located on the exposed surface of the ceiling, wall or other object (as discussed above) to efficiently dissipate heat into the environment on the exposed surface side of the ceiling, wall or object. However, in examples in which the third heat sink member 106 also functions as a retaining surface or plaster/mud plate as discussed above, it may be desirable to minimize thermal expansion and contraction of the third heat sink member 106, to avoid forming cracks, gaps or separations in the plaster material, as the third heat sink member 106 receives and dissipates heat. More specifically, as heat is transferred to the third heat sink member 106 (e.g., from the second heat sink member) or is dissipated from the third heat sink member 106 (e.g., into the environment on the exposed side of the ceiling, wall or other object), the third heat sink member may heat up or cool down. As the temperature of the third heat sink member changes, the third heat sink member 106 may expand or contract in one or more dimensions (e.g., radially), due to thermal expansion or contraction. In certain lighting device assemblies 100, this thermal expansion and contraction may occur over multiple cycles, over the operational life of the lighting device assembly 100.

Most or all of the risk of cracking, separations or gaps in the above-noted materials tends to occur at the outer peripheral portion or the outer perimeter or peripheral edge of the third heat sink member 106. Accordingly, in certain examples, the plaster/mud openings in the third heat sink member 106 or other aspects of the third heat sink member 106 are configured to reduce the transfer of heat to the outer peripheral portion (or the outer peripheral edge) of the third heat sink member 106.

In certain examples, the plaster/mud openings in the third heat sink member 106 may be arranged in a plurality of regions, where each region is within a radial distance or range of the center of the third heat sink member 106. With reference to the example in FIG. 6, a first region 200 is located between the central opening 106*a* and a first radial distance D1 from the center of the third heat sink member 106. A second region 202 is located annularly around the first region 200 and extends from radial distance D1 to radial distance D2 from the center of the third heat sink member 106. A third region 204 is located annularly around the second region 202 and extends from radial distance D2 to radial distance D3 from the center of the third heat sink member 106. In some examples, the outer dimension of the third region (e.g., the radial distance D3 in FIG. 6) may correspond to (e.g., as being equal or substantially equal to) the outer dimension (or outer radial dimension) of the third heat sink member 106. In other examples, one or more additional annular regions may be located around the third region 204.

In some examples, the outer dimension of the first region 200 (e.g., the radial distance D1 in FIG. 6) may correspond to (e.g., as being equal or substantially equal to) the outer dimension (or radial dimension) of the second heat sink member 104. In those examples, when the third heat sink member 106 is connected to the second heat sink member 104, the entire (or substantially entire) first region 200 may be arranged in direct thermal contact with the second heat sink member 104, while the second region 202 may be arranged radially outward of (and out of direct thermal contact with) the second heat sink member 104. Accordingly, the first region 200 of the third heat sink member 106 may be arranged to receive and dissipate heat directly from the second heat sink member 104, while the second region 202 of the third heat sink member 106 remains out of direct contact with the second heat sink member 104.

In particular examples, the sizes, shapes or arrangement (or any combination thereof) of the openings in the second region 202 are configured to reduce heat conduction radially outward of the annular second region 202. In the example in FIG. 6, the first region 200 includes a first plurality of openings, each having a first size (or having two or more different sizes that are smaller than a predefined size). The second region 202 includes a second plurality of openings, each having a second size that is larger than the first size (or having two or more different sizes that are equal or greater than the predefined size). Alternatively or in addition, the second plurality of openings in the second region 202 are arranged at a higher density (e.g., spaced closer together from edge-to-edge of adjacent openings) than the first plurality of openings in the first region 200.

Accordingly, in certain examples, the openings in the second region 202 are larger or are arranged denser (or both) than the openings in the first region 200. As a result, the amount of body material (material of the third heat sink in a square centimeter or other area dimension) available to conduct heat across the second region 202 is reduced relative to the first region. Alternatively or in addition, the openings in the second plurality of openings may have a polygonal shape or other shaped to reduce or further reduce the amount of body material available to conduct heat across the second region 202. Accordingly, heat transferred to the first portion of the third heat sink member 106 from the second heat sink member 104, may be inhibited from transferring across the annular array of the second plurality of openings 202. Therefore, the amount of heat transferred to the outer peripheral portion (or the outer peripheral edge) of the third heat sink member 106 may be reduced, to thereby reduce or avoid thermal expansion or contraction of the outer peripheral portion (or the outer peripheral edge) of the third heat sink member 106.

The third region 204 may include further openings for receiving plaster materials, or the like. In addition, one or more further openings may be provided in the first region 200 (or in other regions 202 or 200) to receive one or more fasteners (e.g., fasteners 110*a* and 110*b*) for connecting the third heat sink member 106 to the second heat sink member 104. In further examples, the third heat sink member 106 may include one or more further openings provided in the third region 204 or in the second region 202, to receive one or more fasteners (not shown) for connecting the third heat sink member 106 to the ceiling, wall or other object.

In the example in FIG. 6, the plaster/mud openings in the first region 200 may be arranged to provide radial paths for heat dissipation. As shown in FIG. 6, the openings in the first region are aligned with each other to form a plurality of radial lines or spokes that extend, generally radially outward from the central opening 106*a*. The spokes define radial paths of body material (material of the third heat sink) between adjacent radial lines of openings. In certain examples as shown in FIG. 6, the radial lines of openings may extend outward and curve or spiral in one direction, to provide spirally curved, radial paths of body material between adjacent pairs of spiral lines of openings. The spirally curved paths increase the length of body material through which heat may be conveyed and dissipated in the first region 200. Accordingly, the spirally curved paths can enhance the ability of the third heat sink member to receive and dissipate heat from the second heat sink member 104.

In other examples, the plaster/mud openings in the first region 200 may be provided in other suitable arrangements or patterns. Accordingly, the example in FIG. 6 is representative, but not limiting of the arrangements and patterns of openings in the third heat sink member 106. In further examples, the third region 204 may be omitted.

Also, while the third heat sink member 106 in the example in FIGS. 1-6 has a round shape, other examples may include third heat sink members having other shapes as described herein. In such other examples, the first, second and third regions may have round or non-round shapes, and may be arranged at different relative distances from the central opening 106*a*. In those or other examples, the second and third regions may be annular or partially annular, with the second region surrounding (or partially surrounding) the first region, and with the third region surrounding (or partially surrounding) the second region. In certain examples, one or more (or each) of the first, second and third regions has an outer peripheral shape that corresponds with (e.g., is the same or matches) the outer peripheral shape of the third heat sink member 106. For example, in embodiments in which the outer peripheral shape of the third heat sink member 106 is polygonal, then the outer peripheral shape of each of the first, second and third regions may have the same polygonal shape in the same orientation as the polygonal shape of the outer periphery of the third heat sink member 106.

The optic member 112 may be secured to the first heat sink member as described herein. The optic member 112 has a lens body through which light may pass. The lens body of the optic member 112 may be made of any suitable material that passes and directs light such as, but not limited to plastic, glass or other ceramic, composite material, or combinations thereof. The optic member 112 has a light entry side (the side facing upward in the orientation of FIGS. 3 and 4) and a light exit side (the side facing downward in the orientation of FIGS. 3 and 4). The light entry side of the optic member 112 may have a recess or cavity 112*a* defining a cavity side-wall or surface 112*a*1 and a cavity end-wall or surface 112*a*2. The cavity end-wall or surface 112*a*2 may have a convex-curved or dome shape.

The light exit side of the optic member 112 has a central convex or dome shaped portion 112*b* and one or more further portions 112*c* around the dome shaped portion 112*b*. In some examples, the one or more further portions 112*c* may have a concave shape as shown in FIGS. 3 and 4. In other examples, the one or more further portions 112*c* may have a convex shape or a flat (neither concave nor convex) shape, or any combination of concave, convex and/or flat shapes. The light exit side of the optic member 112 also includes an annular lip or flange 112*d* that extends radially outward (relative to the axis A) of the optic member 112. The optic member 112 has one or more side surfaces 112*e* between the light entry side and the light exit side. The side surface(s) 112*e* may be provided with a reflective coating or otherwise formed to reflect light inward and toward the light exit side of the optic member.

The optic member 112 is configured to direct light from the exit side, through the light passage aperture or opening in the first side of the first heat sink member 102 and the aligned openings in the second heat sink member 104 and the third heat sink member 106. In particular examples, the optic member 112 is configured to focus and direct light in a manner to pass most of the light emitted from the light source 108 through a relatively small opening in the aperture member 116. In certain examples, some of the light passing through the optic member 112 may be focused by the optic member 112 to one or more focus points along the axis A, where the light rays may form a cone that expands outward from the focus point(s) to illuminate a larger area than the area of the relatively small light passage aperture of the aperture member 116. In certain examples, another portion of the light passing through the optic member 112 is directed along or substantially parallel to the axis A.

The optic member 112 may be arranged and held at least partially within the interior volume of the recess or cavity 102*b* of the first heat sink member 102. In the example shown in FIGS. 3 and 4, the optic member 112 is arranged adjacent the light source 108 on the surface 102*a* of the first heat sink member 102 such that the cavity 112*a* in the optic member 112 covers or partially covers the light source 108. Accordingly, light from the light source may be emitted into the cavity 112*a*, pass through the body of the optic member, and exit from the light exit side of the optic member.

In the example shown in FIGS. 3 and 4, the optic holder 114 is configured to secure and hold the optic member 112 in place, adjacent the light source 108. The optic holder 114 may be located within the recess or cavity 102*b* of the first heat sink member 102 and may be secured to the first heat sink member 102 by one or more connection mechanisms or fasteners such as, but are not limited to bolts, screws, or other threaded fasteners, rivets, glue or other adhesive, solder, welds, clamps, friction or press fitted features, combinations thereof, or the like. In the example in FIGS. 3 and 4, a threaded bolt fastener 122 is shown, for securing the optic holder 114 to the first heat sink member 102. In certain examples, the first heat sink member 114 may include an opening or passage through which one or more electrical wires 120 or other electrical conductors may extend, to connect to the light source 108 and provide power or control signals (or both) to the light source 108.

The optic holder 114 forms a bracket having a generally cylindrical receptacle for receiving the optic member 112, and an annular ridge or lip 114*a* that engages the annular lip or flange 112*d* of the optic member 112, to retain the optic member 112 within the recess or cavity of the first heat sink member 102. In particular examples, the optic holder 114 has a size and dimension that fits fully inside the recess or cavity of the first heat sink member 102. The optic holder 114 may have a size and dimensions that are sufficiently smaller than the size and dimensions of the recess or cavity of the first heat sink member 102 (and of the opening to the recess or cavity of the first heat sink member 102), to allow the optic holder 114 and the optic member 112 to be readily inserted through the opening of the recess or cavity in the first heat sink member, and mounted to first heat sink member 102 during manufacture or installation of the lighting device assembly 100. The optic holder 114 may be made of any suitably rigid material such as, but not limited to, metal, plastic, ceramic, composite material, or combinations thereof.

The aperture member 116 includes a cup-shaped body that has a large opening 116*a* facing the optic member 112, and a small opening facing in the direction of the outward facing side of the lighting device assembly 100, (i.e., downward in the orientation of FIGS. 3 and 4). The aperture member 116 is arranged to allow light from the light exit side of the optic member 112 to enter the large opening 116*a*, pass through body of the aperture member 116 and exit the small opening 116*b*. In certain examples, the small opening 116*b* may be made sufficiently small to hide, reduce or minimize the visual appearance of the lighting device assembly, when installed in a ceiling, wall or other object.

The interior of the cup-shaped body of the aperture member 116 may have an angled or curved inner surface, extending between the large opening 116*a* to the small opening 116*b*. The inner surface includes one or more (or a plurality of) steps 116*c* adjacent and around the small opening 116*b*, to reduce the thickness dimension of the aperture member 116 at the small opening 116*b*, relative to other portions of the body of the aperture member 116. The steps 116*c* allow the aperture member to have a sufficient thickness over most of the body, for example, to provide the body with suitable strength and rigidity, while allowing the edge of the small opening 116*b* to be relatively thin to avoid, reduce or minimize interference with light rays passing through the small opening 116*b*. In some examples, the inner surface of the aperture member 116 may be made of or coated with a dark, black or light absorbing material such as, but not limited to Vantablack™, black ink or paint, or other black or dark material or coating. In such examples, the light absorbing inner surface of the aperture member 116 avoids, reduces or minimizes reflection of light beams within the aperture member 116.

In certain examples, the edge 116*d* of the small opening 116*b* has a curved or an angled surface that curves or angles radially outward toward the outward facing side of the lighting device assembly 100 (i.e., downward and radially outward in the orientation of FIGS. 3 and 4). The curvature or angle of the edge 116*d* may be configured to avoid, reduce or minimize interference with light rays passing through the small opening 116*b*. In particular examples, the angle of the edge 116*d* is equal or greater than the maximum angle of light rays that exit the optic member 112.

The aperture member 116 is connected to and held by the second heat sink member 104. When connected, a portion of the cup-shaped body of the aperture member 116 may protrude or extend outward (downward in the orientation of FIGS. 3 and 4) from the second heat sink member 104. In the example in FIGS. 3 and 4, the cup-shaped body of the aperture member 116 includes a threaded surface 116*e* that engages and threads with a threaded edge 114*e* of the second heat sink member 114, to connect the aperture member 116 to the second heat sink member 114. In other examples, the cup-shaped body of the aperture member 116 is connected to the second heat sink member 104 in any other suitable manner such as, but not limited to, a threaded connection, snap connection, friction fitted connection, or one or more connection mechanisms or fasteners such as, but are not limited to bolts, screws, or other threaded fasteners, rivets, glue or other adhesive, solder, welds, clamps, combinations thereof, or the like.

The diffuser lens 118 is held between the aperture member 116 and a radially inward directed flange or lip 104*f* on the yoke section 104*b* of the second heat sink member 104. In particular examples, the diffuser lens 118 is secured and held by a compressive force between the aperture member 116 and the flange or lip 104*f*, when the aperture member 116 is threaded a sufficient distance within the opening 104*a* of the second heat sink member 104. In certain examples, the diffuser lens 118 diffuses light that exits from the exit side of the optic member 112, before the light passes through the aperture member 116. In such examples, the diffuser lens 118 may blend light rays, light beam artifacts and discolorations that may be produced by the light source 108.

In other examples, instead of a diffuser lens, the lens 118 may comprise other optical devices such as, but not limited to, other types of lenses, color filters, other types of filters, transparent covers for inhibiting passage of moisture, dust or the like, combinations thereof, or the like. In certain examples, the lens 118 may sufficiently enclose or seal the cavity in the first heat sink member 102, to inhibit the passage of moisture, dust or other materials into the cavity and, therefore, to allow the lighting device assembly 100 to be installed in various types of environments, such as, but not limited to showers, bathrooms, outdoors, workplace or other environments. In certain examples, the lighting device assembly 100 may be sufficiently enclosed or sealed to meet certain government or regulatory requirements for such installation environments.

As described herein, the lighting device assembly 100 may be configured to be installed in a recess within a ceiling, wall or other object 101. In such examples, to install the lighting device assembly 100, the first heat sink member 102 may be inserted into a recess that has been formed within a ceiling, wall or other object. In some examples, the first heat sink member may be secured to the ceiling, wall or other object by any suitable securing mechanism including, but not limited to one or more brackets, bolts, screws, or other threaded fasteners, adhesive, clamps, friction or press fitted features, combinations thereof, or the like. In other examples, the first heat sink member is held in the ceiling, wall or other object by the third heat sink member 106 (e.g., by attaching the second and third heat sink members 104 and 106 to the first heat sink member 102 and securing the third heat sink member 106 to the ceiling, wall or other object, as described herein). Before or after inserting the first heat sink 102 into the recess of the ceiling, wall or other object 101, the electrical wires or other conductors 120 may be electrically connected to suitable electrical conductors, drivers or other power sources located within the ceiling, wall or other object.

In particular examples, the light source 108, the optic member 112 and the optic holder 114 are each secured to the first heat sink member 102, before the first heat sink member 102 is inserted into the recess in the ceiling, wall or other object as described above. In other examples, one or more (or each) of the light source 108, the optic member 112 and the optic holder 114 is secured to the first heat sink member 102, after the first heat sink member 102 is inserted into the recess in the ceiling, wall or other object as described above. In further examples, one or more (or each) of the light source 108, the optic member 112 and the optic holder 114 may be removed from or replaced in the first heat sink member 102, while the first heat sink member 102 is in the recess in the ceiling, wall or other object.

Once the first heat sink member 102 is received in the recess in the ceiling, wall or other object as described above, the second heat sink member 104 may be secured to the first heat sink member 102. As described above, the second heat sink member 104 may be connected to the first heat sink member 102 by aligning and engaging the yoke section 104*b* of the second heat sink member 104 with the aperture or opening to the recess or cavity 102*b* of the first heat sink member 102. Then, the second heat sink member 104 may be rotated (e.g., by manually rotating the second heat sink member 104 about an axis A of the aperture or opening, relative to the first heat sink member 102), to thread and connect the yoke section 104*b* with the threaded aperture or opening in the first heat sink member 102. The second heat sink member 104 may be rotated about the axis A until the second surface (the downward facing surface in the orientation of FIGS. 3 and 4) of the second heat sink member 104 abuts the first surface (the downward facing surface in the orientation of FIGS. 3 and 4) of the first heat sink member 102.

Once the second heat sink member 104 is connected to the first heat sink member 102, the diffuser lens 118 may be inserted into the second heat sink member 104, through the opening 104*a*, and the aperture member 116 may be secured to the second heat sink member 104 to hold the diffuser lens 118 in place. The aperture member 116 may be connected to the second heat sink member 104 by aligning and engaging the threaded surface 116*e* of the aperture member 116 with the threaded edge 104*e* of the opening 104*a* of the second heat sink member 104, and rotating (e.g., manually) the aperture member 116 about the axis A to thread the aperture member 116 with the second heat sink member 104. The aperture member 116 may be rotated about the axis A until the aperture member 116 abuts and presses the diffuser lens 118 against the flange 104*f* of the second heat sink member 104, to hold the diffuser lens 118 in place.

Once the aperture member 116 is connected to the second heat sink member 104, the third heat sink member 106 may be secured to the second heat sink member 104. In particular examples, the third heat sink member 106 may be positioned (e.g., manually held) with the opening 106*a* aligned with the aperture member 116 and, then, moved (e.g., manually pushed) toward the second heat sink member 104 to pass the protruding portion of the aperture member 116 through the opening 106*a*. The third heat sink member 106 may be moved (e.g., pushed) to a position to be directly adjacent (or abut) the outward-facing surface of the ceiling, wall or other object, and to abut a second surface of the third heat sink member 106 (the upward facing surface in the orientation of FIGS. 3 and 4) with the first surface of the second heat sink member 104 (the downward facing surface in the orientation of FIGS. 3 and 4). In that orientation, the third heat sink member 106 may be secured to the second heat sink member 104 with a connection mechanism (e.g. one or more fasteners as described herein). In certain examples, the third heat sink member 106 may be secured to the ceiling, wall or other object 101, by one or more fasteners (not shown) received through one or more openings in the second or third regions 202 or 204 of the third heat sink member 106, as described herein.

Once the third heat sink member 106 is secured to the second heat sink member 104 (and/or to the ceiling, wall or other object), one or more plaster materials, such as commonly known or used as plaster, joint compound, spackling, drywall mud, gypsum-based paste, putty, or the like, may be applied to the exposed surface of the third heat sink member 106 (the downward facing surface in the orientation of FIGS. 3 and 4). In particular examples, the one or more materials may be applied to the exposed surface of the third heat sink member 106 by any suitable technique, including, but not limited to spreading the material manually, for example with a spatula or other spreading tool. In particular examples, the one or more materials may be applied to the third heat sink member in a manner to force some of the material(s) into the openings in the regions 200, 202 and 204 of the third heat sink member 106, and against a portion of the exposed surface of the ceiling, wall or other object 101.

In some examples, the one or more materials may be applied over the peripheral edge of the third heat sink member 106, to form a smooth (or smooth-appearing) transition from the exposed surface of the third heat sink member 106 to the exposed surface of the ceiling. In certain examples, the one or more materials is applied over the entire body of the third heat sink member 106 and over its peripheral edge, to effectively hide the third heat sink member 106 under a layer of the material(s). The material may be forced into the plaster/mud openings in the first, second and third regions 200, 202 and 204 of the third heat sink member 106, to help hold or retain the material on the third heat sink member 106. In certain examples, the one or more materials are configured to be applied in a wet or paste-like form, and dry or solidify after being applied to the third heat sink member 106, to cover and hold or help hold the third heat sink member 106 (and the lighting device assembly 100) to the ceiling, wall or other object. In other examples, the one or more materials may be omitted, such that the third heat sink member 106 remains exposed or in view, when installed.

In other examples of installation processes, the order of securing or connecting components may be different than the order expressed above. As such, in other examples, the aperture member 116 and/or the diffuser lens 118 may be secured to the second heat sink member 104, before the second heat sink member 104 is secured to the first heat sink member 102. In other examples, the second heat sink member 104 (with or without the aperture member 116 and the diffuser lens 118) may be secured to the first heat sink member 102, before the first heat sink member 102 is received within the recess in the ceiling, wall or other object 101, such that the first and second heat sink members 102 and 104 (with or without the aperture member 116 and the diffuser lens 118) are installed, together, as a single unit, in the recess, wall, or other object 101. In yet other examples, the first, second and third heat sink members 102, 104 and 106 may be secured together (with the aperture member 116 and the diffuser lens 118), and are all installed, together, as a single unit, in the recess, wall, or other object 101.

In various examples described herein, certain components are described as having a round shape, cup shape, or cylindrical shaped portions, including, but not limited to the first, second and third heat sink members 102, 104 and 106, the yoke section 104*b* of the second heat sink member 104, the optic holder 114, and the aperture member 116. However, in other examples, those components may have other suitable shapes including, but not limited to shapes having polygonal or other non-circular cross-sections (taken perpendicular to the axis A) or combinations thereof. In some examples, those components may have an outer shape configured to provide an aesthetically pleasing, artistic, industrial or other impression.

The foregoing description of illustrative embodiments has been presented for purposes of illustration and of description. It is not intended to be exhaustive or limiting, and modifications and variations may be possible in light of the above teachings or may be acquired from practice of the disclosed embodiments. Various modifications and changes that come within the meaning and range of equivalency of the claims are intended to be within the scope of the invention. Thus, while certain embodiments of the present invention have been illustrated and described, it is understood by those of ordinary skill in the art that certain modifications and changes can be made to the described embodiments without departing from the spirit and scope of the present invention as defined by the following claims, and equivalents thereof.

What is claimed is:

1. A lighting device assembly comprising:

a first heat sink member;

a light source attached to the first heat sink member;

at least one further heat sink member supported by the first heat sink member, the at least one further heat sink member including a further heat sink member comprising a generally plate-shaped body having an outer perimeter and a plurality of openings configured to receive one or more materials consisting of plaster, joint compound, spackling, drywall mud, gypsum-based paste, paste or putty;

the body of the further heat sink member having a first region and a second region, the second region at least partially surrounding the first region, the second region of the body of the further heat sink having a reduced heat conduction capability relative to the first region of the further heat sink, to at least partially inhibit a transfer of heat to the outer perimeter of the body of the further heat sink member.

2. The lighting device assembly of claim 1, wherein the plurality of openings include a first plurality of openings in the first region of the further heat sink member, and a second plurality of openings in the second region of the body of the further heat sink member, the second plurality of openings having sizes, shapes, arrangements or combinations thereof configured to provide the second region with reduced heat conduction qualities relative to the first region of the body of the further heat sink member.

3. The lighting device assembly of claim 2, wherein the first plurality of openings comprise openings that have a first size, the second plurality of openings comprise openings that have a second size, and the second size is larger than the first size.

4. The lighting device assembly of claim 2, wherein the first plurality of openings comprise openings that have a first shape, the second plurality of openings comprise openings that have a second shape, and the second shape is different than the first shape.

5. The lighting device assembly of claim 2, wherein the first plurality of openings comprise openings that are arranged in a first array, the second plurality of openings comprise openings that are arranged in a second array, and the second array has a different pattern than the first array.

6. The lighting device assembly of claim 5, wherein the first array comprises the openings arranged in a plurality of radial lines or spokes extending from a central opening in the further heat sink member, and wherein the radial lines or spokes define radial heat transfer paths between adjacent pairs of radial lines of openings.

7. The lighting device assembly of claim 6, wherein each of the radial lines or spokes extend radially outward in a curve or spiral shape.

8. The lighting device assembly of claim 1, wherein the first heat sink member is configured to receive heat generated by the light source and wherein the further heat sink member is arranged in thermal communication with the first heat sink member to receive and dissipate some of the heat received by the first heat sink member.

9. The lighting device assembly of claim 1, wherein the first heat sink member comprises a generally solid, unitary body of metal having a recess or cavity defining an interior volume, wherein the light source is located within the interior volume.

10. The lighting device assembly of claim 1, wherein the at least one further heat sink member includes said further heat sink member and a second heat sink member, wherein the second heat sink member is located between the first heat sink member and the further heat sink member, wherein the second heat sink member is in thermal engagement with the first heat sink member, and wherein the further heat sink member is in thermal engagement with the second heat sink member.

11. The lighting device assembly of claim 10, wherein the first heat sink member has an opening arranged to pass light from the light source, and wherein the second heat sink member has yoke section that engages and threads with a threaded edge of the opening in first heat sink member, to connect the second heat sink member to the first heat sink member.

12. The lighting device assembly of claim 1, further comprising an optic member having a light entry side and a light exit side, the optic member being supported by the first heat sink member with the light entry side in a position to receive light from the light source, the optic member being configured to emit the light from the exit side.

13. The lighting device assembly of claim 12, further comprising an aperture member having a light passage aperture, the aperture member being connected to the second heat sink member in a position to align the light passage aperture to receive and pass light from the light exit side of the optic member.

14. The lighting device assembly of claim 13, wherein the aperture member comprises a body having first and second openings through which the light may pass, the first opening being on a side of the body facing the optic member, wherein the second opening is on a side of the body facing an opposite direction as the side having the large opening, wherein the second opening is smaller than the first opening, and wherein the body of the aperture member has a curved or angled inner surface between the first and the second openings, the angled or curved surface having a plurality of steps surrounding the second opening to reduce a thickness dimension of the body of the aperture member adjacent the edge of the second opening.

15. The lighting device assembly of claim 14, wherein the edge of the second opening is curved or angled radially outward toward a light exit side of the second opening.

16. A lighting device assembly comprising:

a first heat sink member;

a light source attached to the first heat sink member;

an optic member having a light entry side and a light exit side, the optic member being supported by the first heat sink member with the light entry side in a position to receive light from the light source, the optic member being configured to emit the light from the light exit side;

a second heat sink member connected to and in thermal communication with the first heat sink member, the second heat sink member having an opening;

an aperture member having a light passage aperture, the aperture member being connected to the second heat sink member in a position to align the light passage aperture to receive and pass light from the light exit side of the optic member;

wherein the aperture member comprises a body having first and second openings through which the light may pass, the first opening being on a side of the body facing the optic member, wherein the second opening is on a side of the body facing an opposite direction as the side having the large opening, wherein the second opening is smaller than the first opening, and wherein the body of the aperture member has a curved or angled inner surface between the first and the second openings, the angled or curved surface having a plurality of steps surrounding the second opening to reduce a thickness dimension of the body of the aperture member adjacent the edge of the second opening.

17. The lighting device assembly of claim 16, wherein the edge of the second opening is curved or angled radially outward toward a light exit side of the second opening.

18. The lighting device assembly of claim 16, further comprising a third heat sink member connected to and in thermal communication with the second heat sink member, the third heat sink member comprising a generally plate-shaped body having an outer perimeter and a plurality of openings configured to receive one or more materials consisting of plaster, joint compound, spackling, drywall mud, gypsum-based paste, paste or putty.

19. The lighting device assembly of claim 18, wherein the body of the third heat sink member has a first region and a second region, the second region at least partially surrounding the first region, the second region of the body of the further heat sink having a reduced heat conduction capability relative to the first region of the further heat sink, to at least partially inhibit a transfer of heat to the outer perimeter of the body of the further heat sink member.

20. The lighting device assembly of claim 19, wherein the plurality of openings include a first plurality of openings in the first region of the third heat sink member, and a second plurality of openings in the second region of the body of the third heat sink member, the second plurality of openings having sizes, shapes, arrangements or combinations thereof configured to provide the second region with reduced heat conduction qualities relative to the first region of the body of the third heat sink member.

* * * * *